US007286995B2

(12) United States Patent
Mayer et al.

(10) Patent No.: US 7,286,995 B2
(45) Date of Patent: Oct. 23, 2007

(54) METHOD FOR BALANCING MAIL RUNS

(75) Inventors: Paul Mayer, Middlesbury, CT (US); Susan L. Chapin, Sandy Hook, CT (US)

(73) Assignee: Pitney Bowes Inc., Stamford, CT (US)

( * ) Notice: Subject to any disclaimer, the term of this patent is extended or adjusted under 35 U.S.C. 154(b) by 504 days.

(21) Appl. No.: 10/675,347

(22) Filed: Sep. 30, 2003

(65) Prior Publication Data

US 2005/0071291 A1 Mar. 31, 2005

(51) Int. Cl.
*G06Q 99/00* (2006.01)

(52) U.S. Cl. ..... 705/1; 705/401; 705/406

(58) Field of Classification Search ..... 705/400–410, 705/1; 707/200; 209/584, 900
See application file for complete search history.

(56) References Cited

U.S. PATENT DOCUMENTS 4,855,920 A * 8/1989 Sansone et al. ..... 705/401
5,008,827 A * 4/1991 Sansone et al. ..... 705/409
6,365,862 B1 * 4/2002 Miller et al. ..... 209/584
6,687,569 B1 * 2/2004 Skinger et al. ..... 700/220
6,792,332 B1 * 9/2004 DePoi ..... 700/213
2002/0069186 A1 * 6/2002 Moore ..... 705/401
2004/0122781 A1 * 6/2004 Barrows ..... 705/406

FOREIGN PATENT DOCUMENTS

WO WO 03047773 A2 * 6/2003

* cited by examiner

*Primary Examiner*—John W. Hayes
*Assistant Examiner*—Freda A Nelson
(74) *Attorney, Agent, or Firm*—Michaels J. Cummings; Steven J. Shapiro; Angelo N. Chaclas

(57) ABSTRACT

A method to reduce and manage the risks and costs associated with mail piece account balancing failures in connection with automated high speed mail production equipment. A mail run is divided into defined subsets of sequentially numbered mail pieces. Disposition of mail pieces is accounted for during the automated mail production process. Gaps in the subsets are identified. The number of subsets with gaps is tracked during automated processing of mail pieces. If the number of defective subsets exceeds a predetermined quantity, then the mail production equipment is stopped. In a further preferred embodiment, operators are notified of the occurrence of gaps in real-time, as they are detected, so that corrective action may be taken.

15 Claims, 4 Drawing Sheets

METHOD FOR BALANCING MAIL RUNS

TECHNICAL FIELD

The present invention relates to a method for ensuring accuracy of mail runs created by high speed automated mail production systems. A mail run balancing process attempts to ensure that all documents to be processed by the mail production system are accounted for before the mail run is submitted for delivery.

BACKGROUND

Systems for mass producing mail pieces are well known in the art. Such systems are typically used by organizations such as banks, insurance companies and utility companies for producing a large volume of specific mailings like billing statements, or promotional offers. The starting point for the document production process is a stream of print data generated by the organization wishing to create the mailing. The print stream may be sent to a high volume printer. Such high volume printing results in large rolls or stacks of documents, usually connected in a continuous web. The webs of documents are transported to an inserter machine to be separated into individual pages and turned into mail pieces. Examples of such inserter systems are the 8 series the 9 series or APS™ inserter systems available from Pitney Bowes Inc. of Stamford Conn.

Mail pieces are typically processed in large groups called "mail runs." Several thousand related mail pieces are typically grouped together in a mail run, with similar types of processing and inserts. Mail runs are typically tracked and managed as a group, and mail runs are conventionally submitted to a delivery service for delivery as a group.

In many respects the typical inserter system resembles a manufacturing assembly line. Sheets and other raw materials (other sheets, enclosures, and envelopes) enter the inserter system as inputs. A plurality of different modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

Each collation of documents processed by the inserter system typically includes a control document having coded control marks printed thereon. Scanners are located throughout the inserter system to sense documents and to allow control for processing of a particular mail piece. The coded marks may be bar codes, UPC code, or the like.

The inserter system control system is coupled to the inserter system's modular components. The control system stores data files with instructions of how individual mail pieces are to be processed. These data files are typically linked to individual mail pieces by the coded marks included on the control documents. As a collation passes through the inserter system, the coded marks on the control document are scanned and the control system directs the modular components to assemble the mail piece in accordance with the instructions for the piece.

At the various stages of the mail production and management process, sensors help to identify errors and mishandling of mail pieces. When an error is detected am error notification is typically generated. Such notification is provided to the local operator so that corrective action can be taken.

Once a finished mail piece has been formed, it is typically stacked in preparation for transfer to a carrier service, such as the U.S. Postal Service. Often, in order to receive postal discounts, it is advantageous to sort the outgoing mail in accordance postal regulations using known sorting devices.

Prior to transfer to the delivery service, completed mail runs are typically checked for quality and completeness. Because of the high volume of mail that is handled, occasionally a document submitted to the mail production equipment for processing cannot be accounted for at the output end. The unaccounted for mail pieces may have been mishandled, damaged, destroyed, or misplaced.

There are different costs associated with unaccounted for mail pieces. One cost is the expense of resubmitting and reprocessing the mail piece to ensure that the recipient gets the communication. Another cost may be harm caused if a missing document was accidentally stuffed into the wrong envelope and was sent to the wrong recipient. Depending on the particular circumstances, mailers will weigh the costs and risks and determine how carefully to balance mail runs.

For some types of mail runs, failure to balance mail piece accounts may not be significant. As an example, for a mailing that merely included a department store coupon, a mailer might decide to send out an unbalanced mail run. In this case, the mailer is risking the cost that a recipient might receive a coupon that was intended for someone else. This cost most likely would not justify redoing the entire mail run. Rather the missing mail piece might be reprinted and sent, and the balancing failure could be ignored.

However, if the mail run included financial, medical, or other sensitive information, a mailer may need 100% balancing before submitting a mail run for delivery. The potential harm, and loss of customer trust, if sensitive information were sent to the wrong recipient could be very damaging. In practice, some mailers have been known to bear the costs of discarding entire mail runs and completely redoing them when perfect balancing cannot be achieved.

With balancing considerations in mind, mailers decide how large to make their mail runs. To realize the full efficiencies of higher speed equipment, mailers tend to want to make larger mail runs. Making smaller mail runs can result in more set-up and downtime for the equipment. However, larger mail runs are more likely to result in a balancing failure, and are more expensive to discard and reprocess. These competing concerns may result in a mail producer using its mail production equipment at less than optimal volumes.

Another consideration in regard to balancing is the time that the effort takes. Often mailings are on a tight schedule, and sometimes time consuming mail piece account balancing issues can jeopardize meeting of deadlines.

SUMMARY OF THE INVENTION

The present invention provides a method to reduce and manage the risks and costs associated with mail piece account balancing failures in connection with automated high speed mail production equipment. Further, the present invention allows the balancing process to be made more efficient.

These goals are achieved by dividing a mail run into defined subsets. Performing the balancing steps in accordance with the present invention on these defined subsets allows larger mail runs, but with less risk that entire mail runs will require reprocessing. With the present invention some subsets may be successfully balanced and submitted for delivery, while others are delayed because they have unreconciled problems. In accordance with the present invention, the disposition of mail pieces is accounted for during the automated mail production process. Such accounting may include sensing completed documents at the output of the equipment. Such accounting may also include information input by operators, such as identification of mail pieces that were manually repaired and manually replaced in the output stack. The system may further account for mail pieces that are known to have been destroyed, and that will be flagged for reprocessing at a later time.

When the accounting is done, a next step is to identify the "gaps," or unaccounted-for mail pieces, in the defined mail run subsets. Preferably, the mail pieces of a mail run are identified by some kind of non-recurring sequential number. Thus gaps are more easily recognized when the sequence is not in order.

In a preferred embodiment of the invention, the method tracks how many of the subsets include gaps as processing is under way. If the number of defective subsets exceeds a predetermined quantity, then the mail production equipment is stopped. By selecting the predetermined quantity, the operator has some assurance that a portion of the mail run may be suitable for delivery, even if other portions are not. Also, the operator may be comfortable when there are fewer subsets with gaps because it may be likely that such gaps will be resolved when they are flagged and investigated. Accordingly, the predetermined maximum of flawed subsets will be selected, at least in part, based on a comfort level desired by the operator.

In a further preferred embodiment, operators are notified of the occurrence of gaps in real-time, as they are detected, so that corrective action may be taken. Using this preferred embodiment, time is saved by not having to wait until the mail run is completed before addressing the problems. Also, if a serious problem is identified that cannot be resolved, then the mail production process may be stopped in order to minimize the quantity of work that must be discarded and reprocessed.

Further details of the present invention are provided in the accompanying detailed description, figures and claims.

DETAILED DESCRIPTION

Figure 1:
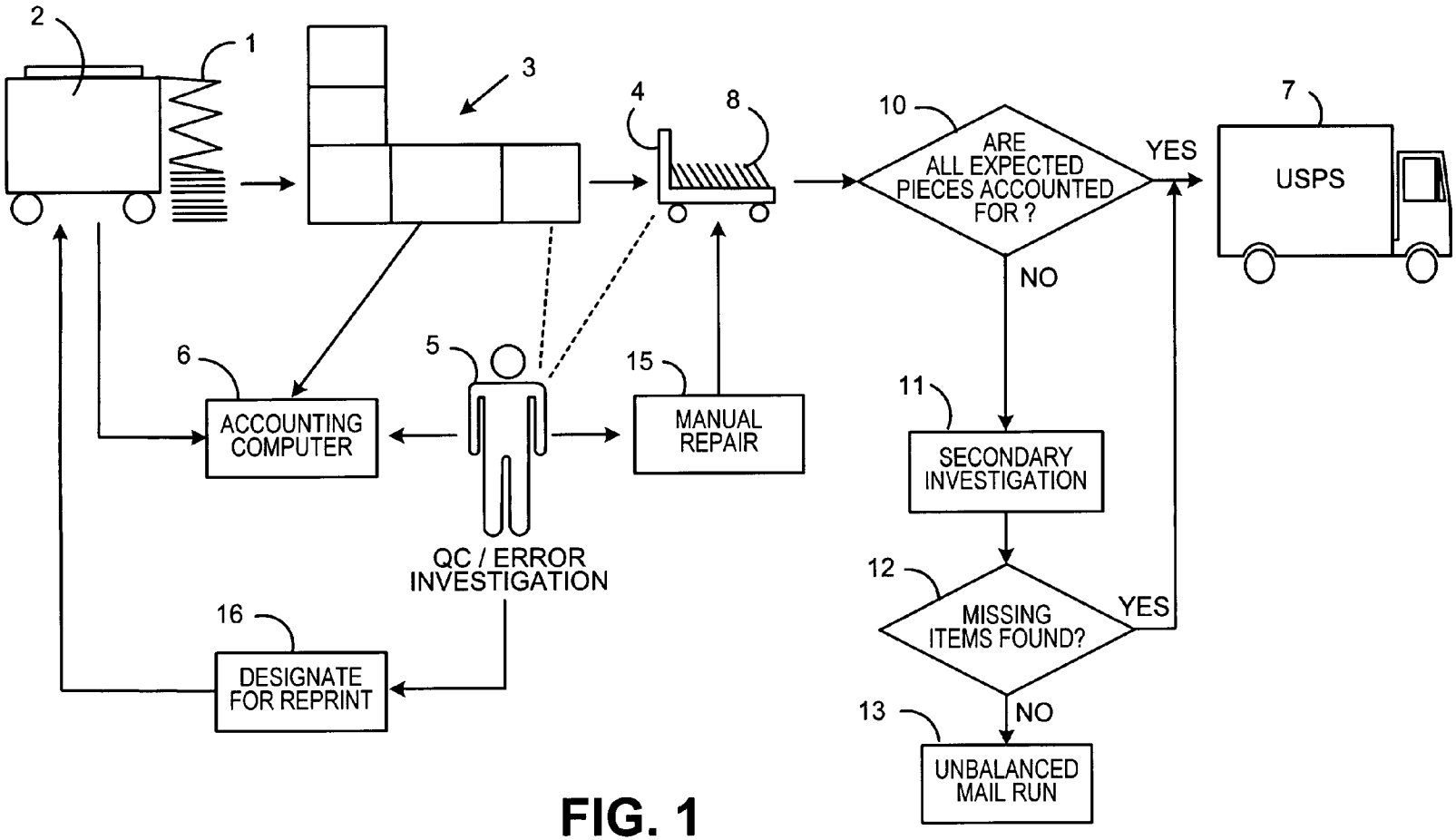
FIG. 1 depicts a mail production and balancing process that may be used in connection with the present invention.

A high level diagram of a mail production process for use with the present invention is depicted in FIG. 1. Documents 1 to be formed into mail pieces are printed by a high volume printer 2. Typically the documents 1 are printed on a continuous web of paper that folds into a stack, or may be rolled onto a spool. For each set of mail piece documents 1 created by the printer 2, the accounting computer 6 is updated to reflect the status of the documents 1.

Preferably, the accounting computer 6 is incorporated into an operating system for the mail production equipment. An example of such an operating system is the Direct Connect operating system available from Pitney Bowes.

The web of documents 1 is received by an inserter system 3. The inserter system 3 (described in more detail below) separates the documents into individual sheets, forms collations of sheets, and stuffs the collations into envelopes. While the mail pieces are being created, the inserter 3 updates the accounting computer 6 with the current status of the mail pieces. For example, if a mail piece is successfully completed and output by the inserter 3, the accounting computer 6 is updated to identify the mail piece as completed and accounted for.

If inserter 3 detects a mistake in a mail piece, it may be diverted to an outsort bin. Such outsorted mail pieces are also identified to the accounting computer 6. An operator 5 may investigate the diverted mail pieces and further identify them as requiring complete reprocessing 16, or alternatively the operator 5 may manually repair 15 the piece and reinstate it too the mail run. In either case, the operator 5 updates the accounting computer 6 with the status of the mail piece. Operator 5 may update the status of mail pieces by typing an entry via keyboard, or by using a hand held scanner.

It is up to the individual mailer to determine what kind of mail piece status do, or do not, qualify as properly accounted for. For example, a mail piece may be known to have been diverted, but the reason for diversion may not be known. Thus a gap, or unbalance, in the mail run may be registered until the operator 5 designates the piece for reprint 16 or manual repair 15. Similarly, a mail piece might fail weight verification. Depending on the priorities of the mailer, a failed weight check may or may not result in the piece being accounted for. If a failed weight check results in marking the pieces as a gap, or unaccounted, then further action may be required by the operator to identify whether the piece requires reprocessing, or is acceptable, and to update the status accordingly.

Completed mail pieces 8 are often stored in a tray or on a cart 4, in preparation for submittal to the delivery service. After a satisfactory balancing of the mail run the completed mail pieces 8 are submitted to the delivery service 7 (U.S. Postal Service, Federal Express, UPS, or the like) for delivery to the recipients.

As shown in FIG. 1, a balancing process includes step 10 of determining if all of the expected mail pieces are accounted for. If so, then the mail run is ready for delivery. If not, then the operators of the mail production system perform a secondary investigation 11 to determine the proper disposition of the identified gaps. If the missing items can be found 12, or otherwise accounted for, then the mail run if finally ready for delivery. If the missing items cannot be resolved, then the mail run is considered unbalanced 13.

Depending on the nature of the mail in the mail run, and the quantity of gaps in the mail run, the mailer may choose to send the unbalanced mail, or to discard the unbalanced run and to reproduce it.

Figure 2:
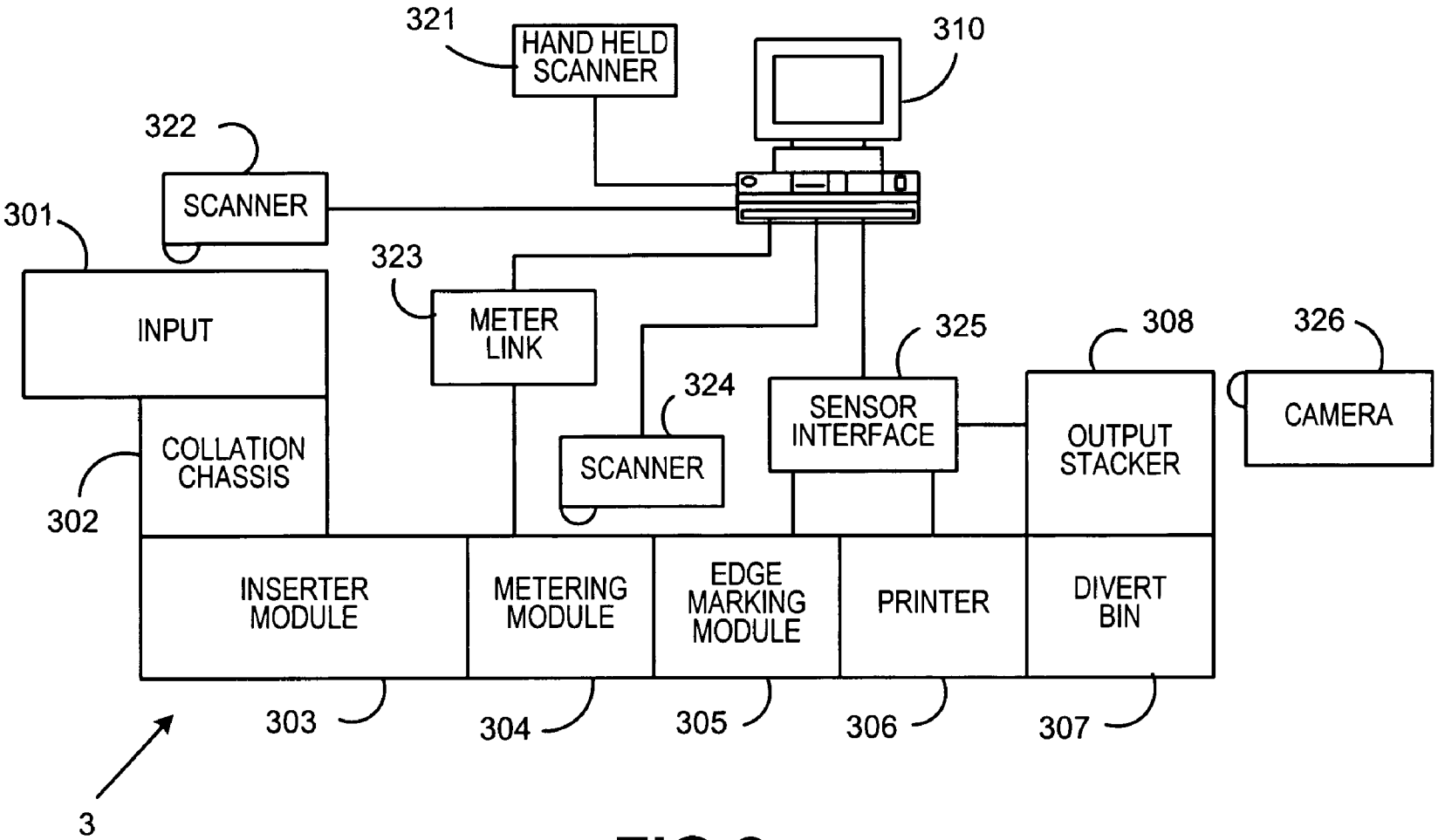
FIG. 2 depicts a typical inserter system that may be used in connection with the present invention.

FIG. 2 provides an exemplary inserter 3, with accompanying sensors and computer control, as may be used with the present invention. A local computer 310 provides the processing instructions to the inserter system 3 and receives the sensor information from the inserter. In the preferred embodiment, computer 310 is the accounting computer 6 that receives mail piece accounting data from the inserter 3 and from an operator 5, as depicted and described in regard to FIG. 1. In addition to receiving information from sensors mounted in the inserter device 3, a hand held scanner 321 is connected to the computer 310 and may be used by an operator to scan and identify mail pieces as appropriate. For example, if a mail piece is damaged and must be reprocessed, an operator may use the hand held scanner 321 to identify the piece and make an appropriate notation in the MRDF files.

Within the inserter, a scanner 322 typically identifies the codes marked on documents as they are fed into the inserter system at the input mechanism 301. The scanner 322 may also check each document as it passes, and compare the data on the document with data in the corresponding print stream file. From this comparison it may be determined if an error has occurred, and an indication may be provided indicating an error. Using this information, the inserter operating system may flag the mail piece as bad.

A collation chassis 302 collects documents and inserts together, and the collations are stuffed into envelopes in an inserter module 303. Stuffed envelopes can be metered at a metering module 304. Such metering activity is in turn monitored and controlled through meter link 323 by local computer 310. A scanner 324 further tracks the progress of documents through the inserter machine by looking for the codes on the documents indicating that the corresponding mail piece has reached the stage at which the scanner 324 is positioned. Scanners 324 may be located at any points within the inserter system 300. Further inserter processing may be carried out at an edge marking module 305 and a printer 306 for putting delivery information onto the stuffed envelopes. Sensors within those modules communicate with sensor interface 325 to provide machine status and document status information to the local computer 310. A divert bin 307 collects misprocessed mail pieces. Preferably, sensors indicate when a mail piece is sent to the divert bin, and a record is made that further processing is required. Finally, an output stacker 308, sorts the finished mail pieces by postal codes in order that the sender may receive postal presorting discounts. In the preferred embodiment, a camera 326 captures an image of the completed envelope, and such image may be associated with the data file for the mail piece.

Figure 3:
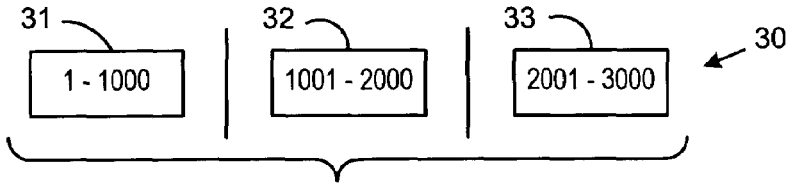
FIG. 3 depicts an example of dividing a mail run into subsets in accordance with the present invention.

FIG. 3 depicts a simplified depiction of a technique for dividing a mail run into subsets for use in connection with the present invention. In this example, a mail run 30 is comprised of 3000 mail pieces. In accordance with the preferred embodiment of the present invention, each mail piece is designated by a sequential identification number, in this case 1-3000. While a purely numerical sequence may be simplest, the sequential identifier may be any kind of alphanumeric identifier that has a known pattern or sequence. In particular, it is important to be able to tell when one or more of the items in the sequence is missing, or out of place.

In the example of FIG. 3, the mail run 30 has been designated as including three subsets, 31 (1-1000), 32 (1001-2000), and 33 (2001-3000). As the mail production process is performed, the mail pieces for subset 31 are created first. If the balancing process determines that subset 31 is balanced, then it may be submitted to a delivery service for delivery, even if subsets 32 and 33 have not been completed. Further balancing steps to be used in connection with the mail run subsets are described in connection with FIGS. 4 and 5.

Figure 4:
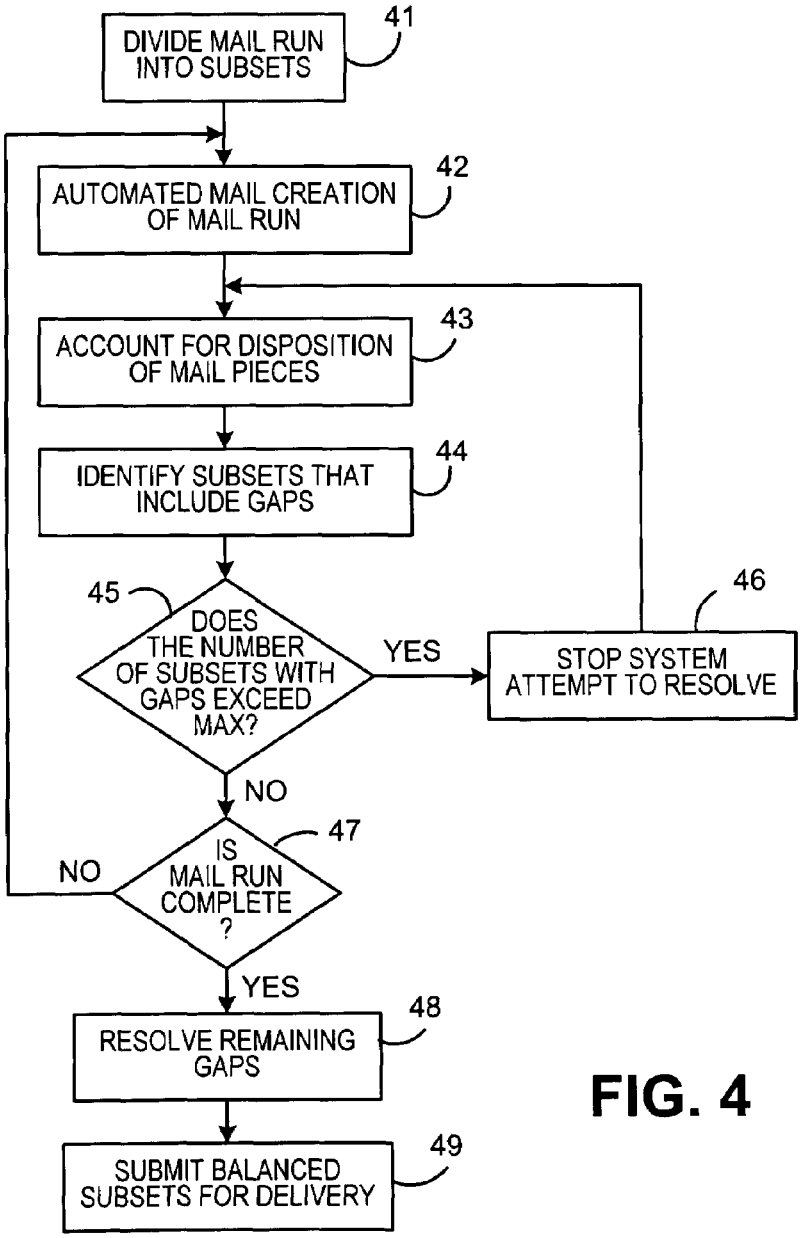
FIG. 4 depicts an exemplary flow diagram of a balancing process in accordance with the present invention.

As seen in FIG. 4, an initial step 41 in accordance with the present invention is to divide the mail run into subsets, for example, as shown in FIG. 3. In a further step 42, the subject mail run is then submitted for processing by automated mail production equipment. At step 43, as mail pieces are processed by the automated mail production equipment the disposition of mail pieces is accounted for. Based on the accounting, at step 44 the subsets that include gaps are identified.

As the various subsets are processed, a further step 45 is to check whether the number of subsets that include gaps exceeds a predetermined number. If the number of subsets with gaps does exceed the predetermined number, than the mail production system is stopped (46). The reason for stopping is to allow the operators to attempt to resolve the gaps in the various subsets. If the gaps are resolved, the number of subsets with problems will no longer exceed the maximum and automated processing resumes. If the system is stopped, and it is found that the gaps cannot be resolved, then a benefit has been realized by not continuing to produce mail pieces that must be discarded and redone.

The predetermined number for triggering the stopping step 46 is chosen based on the mailer's confidence level that a certain quantity of gaps are likely to be resolved. However, as the number of subsets with problems increases, the more likely that the entire mail run will be impossible to balance, and potentially must be discarded.

At step 47 the system determines whether the mail run is complete. If not, the above steps 42, 43, 44, 45, and 46 continue until the mail run is complete. At step 48, the operators attempt to resolve any remaining gaps. Finally, balanced subsets may be submitted for delivery (49). Depending on the associated costs, the mailer may choose to discard and reprocess unbalanced subsets.

Figure 5:
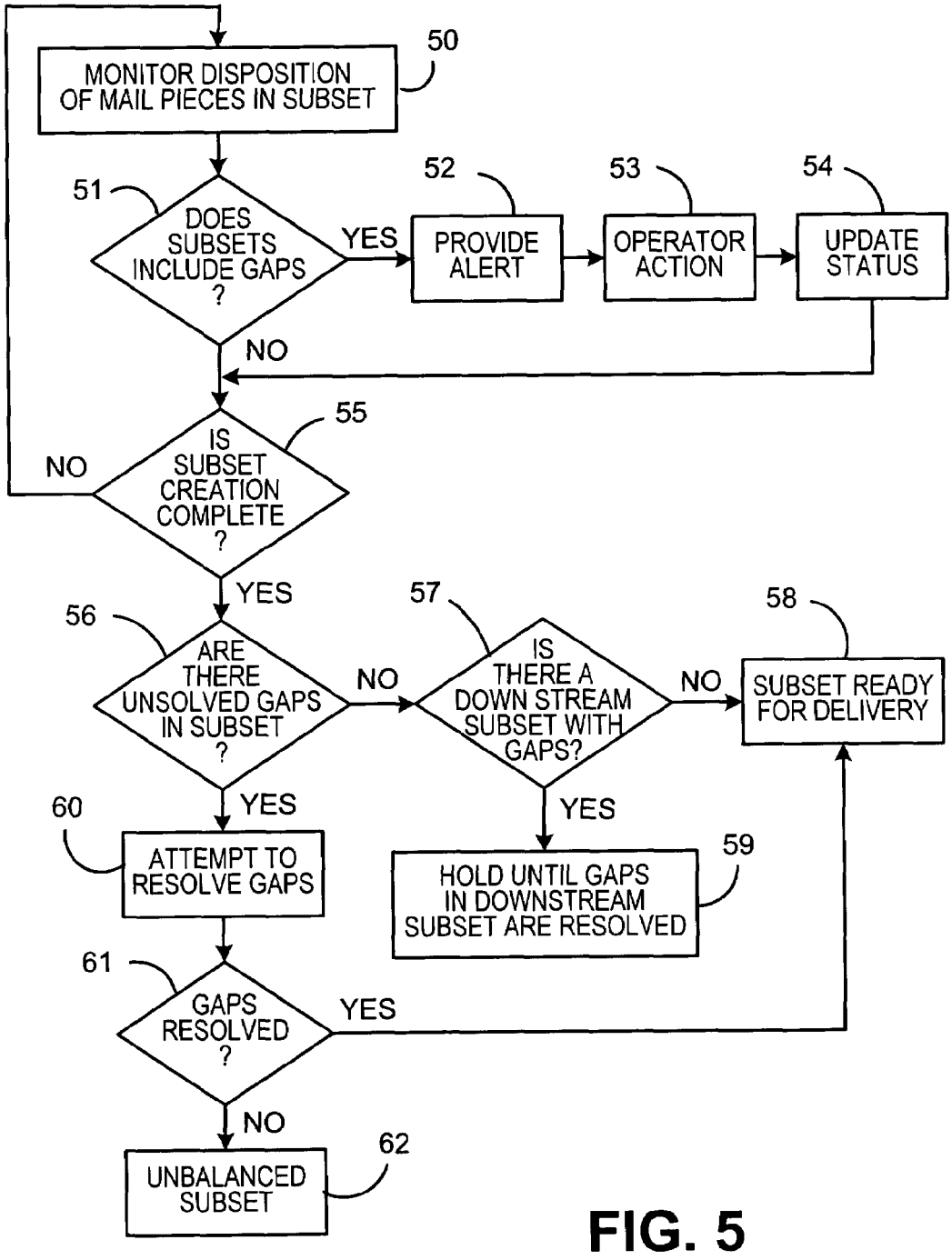
FIG. 5 depicts further exemplary steps of a balancing process in accordance with the present invention.

Further embodiments for a method for balancing mail runs are depicted in FIG. 5. At step 50, the disposition of mail pieces in subsets are monitored. Based on the monitoring, it is determined 51 whether a subset includes gaps. If a gap is found, an alert 52 is provided to notify the operators that a gap has occurred. At step 53, the operator takes action to investigate and resolve the gap in the subset during real-time, while the mail run is still being processed. Actions may include finding that the gap is the result of a mail piece being destroyed, or that a mail piece has been manually repaired and placed back in the mail run. At step 54, the status of the gap is updated to reflect the actions and discoveries of the operator. Using this real time approach to resolving gaps, less time is needed after the mail run is complete to perform a final balancing.

If the subset is not complete (55), then steps 50, 51, 52, 53, and 54 are repeated. If the subset is completed determinations are made to determine if it is ready for submittal for delivery. After the subset is completed, there is a check 56 to see whether there are any remaining unresolved gaps. If there are no unresolved gaps, then a check 57 is made to determine whether any subsets downstream of the completed subset have unresolved gaps. The reason for checking downstream subsets, is that there is some risk that a missing item from a downstream subset could have potentially found its way into an incorrect mail piece. If a downstream subset has gaps, then the completed subset may be held 59 until the gaps are resolved in the downstream subset. If, at step 57, there are no downstream subsets with gaps, then the subset is ready for submittal for delivery (58).

If at step 56, the subset continues to have unresolved gaps, then a further step 60 is taken to attempt to resolve the gaps. If the further attempts 60, to resolve gaps are resolved (61), then the further steps 57 and 59 relating to downstream subsets are taken before the subset is ready for delivery (58). If the gaps in the subset cannot be resolved, it must be handled as an unbalanced subset (62).

Although the invention has been described with respect to preferred embodiments thereof, it will be understood by those skilled in the art that the foregoing and various other changes, omissions and deviations in the form and detail thereof may be made without departing from the scope of this invention.

What is claimed is:

1. A method for balancing a mail run comprised of a plurality of mail pieces assembled on an automated high speed mail production apparatus, the method comprising:

dividing the mail run into defined subsets;

accounting for a disposition of mail pieces processed in the mail production apparatus;

identifying gaps in the subsets wherein the disposition of one or more mail pieces is unaccounted for; and stopping the mail production apparatus if a predetermined number of subsets include identified gaps.

2. The method of claim 1 further comprising the steps of:

determining that a completed subset does not include identified gaps; and submitting the completed subset for delivery prior to finishing balancing for all subsets in the mail run.

3. The method of claim 2 further comprising the steps of:

providing a real-time indication of identified gaps during assembly of the mail run by the mail production apparatus; and resolving the disposition of identified gaps during assembly of the mail run by the mail production apparatus; and updating the accounting of mail piece dispositions based on the resolved gaps.

4. The method of claim 2 further comprising the steps of:

determining whether a downstream subset, processed prior to the completed subset, has one or more unresolved gaps; and if the downstream subset has one or more unresolved gaps, then delaying the step of submitting the completed subset for delivery until the downstream subset's gaps are resolved.

5. The method of claim 1 further including the steps of:

providing a real-time indication of identified gaps during assembly of the mail run by the mail production apparatus; and resolving the disposition of identified gaps during assembly of the mail run by the mail production apparatus; and updating the accounting of mail piece dispositions based on the resolved gaps.

6. The method of claim 1 further including the steps of:

assigning a sequence of identification numbers to the mail pieces in the mail run; and wherein the step of identifying gaps in the subsets includes identifying one or more identification numbers of the sequence that are missing.

7. The method of claim 1 wherein the step of accounting for the disposition of mail pieces includes accounting for items manually repaired by an operator and items that are misprocessed or damaged and require reprocessing.

8. A method for balancing a mail run comprised of a plurality of mail pieces assembled on an automated high speed mail production apparatus, the method comprising:

dividing the mail run into defined subsets;

accounting for a disposition of mail pieces processed in the mail production apparatus;

identifying gaps in the subsets where the disposition of one or more mail pieces is unaccounted for;

determining that a completed subset does not include identified gaps; and submitting the completed subset for delivery prior to finishing balancing for all subsets in the mail run.

9. The method of claim 8 further including the steps of:

determining whether a downstream subset, processed prior to the completed subset, has one or more unresolved gaps; and if the downstream subset has one or more unresolved gaps, then delaying the step of submitting the completed subset for delivery until the downstream subset's gaps are resolved.

10. The method of claim 8 further including the steps of:

assigning a sequence of identification numbers to the mail pieces in the mail run; and wherein the step of identifying gaps in the subsets includes identifying one or more identification numbers of the sequence that are missing.

11. The method of claim 8 wherein the step of accounting for the disposition of mail pieces includes accounting for items manually repaired by an operator and items that are misprocessed or damaged and require reprocessing.

12. A method for balancing a mail run comprised of a plurality of mail pieces assembled on an automated high speed mail production apparatus, the method comprising:

dividing the mail run into defined subsets;

accounting for a disposition of mail pieces processed in the mail production apparatus;

identifying gaps in the subsets where the disposition of one or more mail pieces is unaccounted for;

providing a real-time indication of identified gaps during assembly of the mail run by the mail production apparatus; and resolving the disposition of identified gaps during assembly of the mail run by the mail production apparatus; and updating the accounting of mail piece dispositions based on the resolved gaps.

13. The method of claim 12 further comprising the steps of:

determining that a completed subset does not include identified gaps; and submitting the completed subset for delivery prior to finishing balancing for all subsets in the mail run.

14. The method of claim 13 further including the steps of:

determining whether a downstream subset, processed prior to the completed subset, has one or more unresolved gaps; and if the downstream subset has one or more unresolved gaps, then delaying the step of submitting the completed subset for delivery until the downstream subset's gaps are resolved.

15. The method of claim 12 further including the steps of:

assigning a sequence of identification numbers to the mail pieces in the mail run; and wherein the step of identifying gaps in the subsets includes identifying one or more identification numbers of the sequence that are missing.

* * * * *